United States Patent [19]

Schlack

[11] 4,259,710

[45] Mar. 31, 1981

[54] WATERPROOF LAMP

[76] Inventor: Karl-Friedrich Schlack, Hohler Weg 24, D 493 Detmold 14, Fed. Rep. of Germany

[21] Appl. No.: 20,201

[22] Filed: Mar. 13, 1979

[30] Foreign Application Priority Data

May 26, 1978 [DE] Fed. Rep. of Germany ..... 7815805

[51] Int. Cl.[3] ..... F71V 21/02

[52] U.S. Cl. ..... 362/267; 362/269; 362/368; 362/418

[58] Field of Search ..... 362/145, 153, 267, 269, 362/275, 285, 287, 293, 371, 410, 413, 414, 418, 419, 426, 427, 428, 430

[56] References Cited

U.S. PATENT DOCUMENTS

| | | | |
|---|---|---|---|
| 2,295,339 | 9/1942 | Ericson | 362/267 |
| 2,770,715 | 11/1956 | Stecher | 362/267 |
| 3,213,270 | 10/1965 | Appleton et al. | 362/371 |
| 3,840,734 | 10/1974 | Oram | 362/267 |
| 4,091,444 | 5/1978 | Mori | 362/267 |
| 4,109,301 | 8/1978 | Wakimura | 362/293 |

*Primary Examiner*—L. T. Hix
*Assistant Examiner*—Alan Mathews
*Attorney, Agent, or Firm*—Browdy and Neimark

[57] ABSTRACT

A waterproof lamp, especially for use as an underwater light source in swimming pools and the like, having an enclosure consisting of a housing and a bezel which may be clamped together to hold in place and seal an electrical light source. The bezel is equipped with fingers for releasably holding a color light filter. The lower part of the housing has at least one sealable electrical feed-through and is provided with a pedestal permitting angular orientation. The housing and bezel are preferably made of plastic and are appropriately weighted to a net density greater than water.

10 Claims, 5 Drawing Figures

WATERPROOF LAMP

FIELD OF THE INVENTION

The invention relates to waterproof electrical lamps, for example floodlights for underwater illumination of swimming pools, fountains, and the like. More particularly, the invention relates to a lamp having a two part enclosure consisting of a housing member and a bezel ring which may hold a color filter disc.

OBJECTS AND SUMMARY OF THE INVENTION

It is a principal object of the present invention to provide a waterproof lamp which may be produced of a material permitting simple and favorable manufacture but also permitting the reuse of remnants of the production so that the lamp may be produced economically from the points of view of raw materials and expense. An associated object is to provide an underwater lamp which is electrically secure.

These and other objects are attained according to the invention by providing a waterproof lamp having a bell-shaped outer housing member which is reinforced with external ribs and to which are attached receiver bushings for the passage of electrical cables and the like. An electrical lamp is held within the bell-shaped housing by a front bezel which may be mounted to the housing, for example, by screws and which has provisions for holding a color filter disc.

In a preferred exemplary embodiment of the invention, the electrical cable feedthrough is formed within a lateral extension of the housing in which a suitable threaded bushing is welded.

The threaded bushing may be metal, for example brass, and within it is placed an elastic ring. If the bushing is to be sealed with respect to the outside, a plastic bolt may be placed inside the ring and a hollow screw may be threadedly engaged with the bushing to apply pressure on the bolt and deform the elastic ring, thereby sealing the opening.

Preferably, the entire lamp is constructed of thermoplastic synthetic material with a very short curing time, thereby speeding the production of the various parts of the light. Furthermore, the remnants of production can be used again by being ground up and used in molding new parts. These two factors result in simple, rapid and inexpensive manufacture which imparts to the lamp a very economical construction .

The electrical feedthroughs to the housing are provided by welding or molding therein a threaded bushing after manufacture in a relatively simple and inexpensive manner. If the opening is to be sealed and is not used as an electrical feedthrough, a plastic bolt and an elastic sealing ring may be placed therein and clamped in place by a hollow screw. These elements provide water-tight sealing and electrical insulation with respect to the interior of the housing.

It is an advantageous feature of the invention that the bezel has a downwardly extending rim which overlaps a corresponding shoulder on the housing thereby enhancing the degree of sealing. The bezel is further provided with several threaded extensions into which suitable bolts are screwed that join the bezel to the housing .

The interior of the housing is provided with an electrical ground screw by means of which a grounded switch can be activated if water should accidentally enter the housing.

Still another preferred feature of the lamp according to the invention is the disposition therein of pockets in which a heavy mass can be poured so as to give the lamp a net density greater than water and causing it to sink.

Other features of the invention will appear from the following description of a preferred exemplary embodiment which is illustrated in the drawing.

DESCRIPTION OF THE PREFERRED EMBODIMENT

Figure 1:
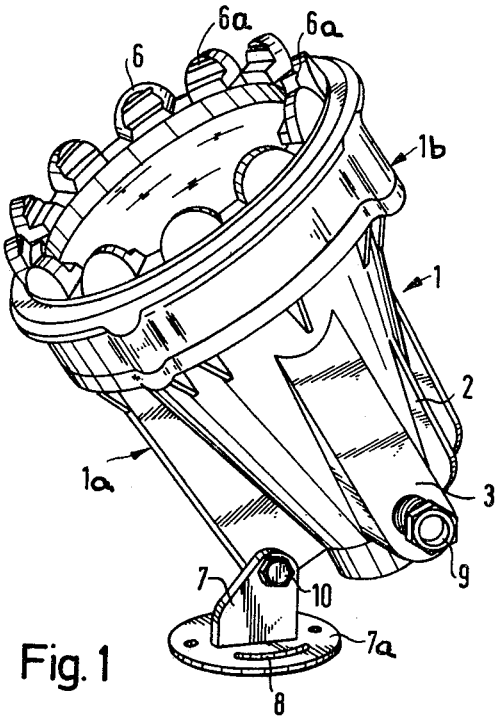
FIG. 1 is a perspective view of a lamp according to the invention.
Figure 2:
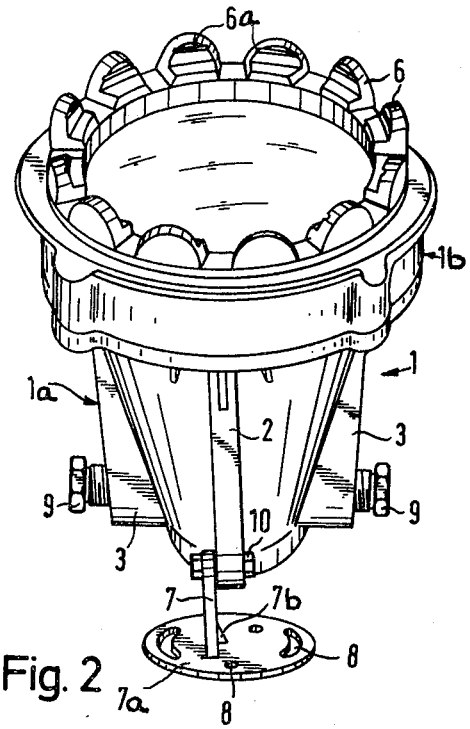
FIG. 2 is a view similar to that in FIG. 1 from a different angle.
Figure 3:
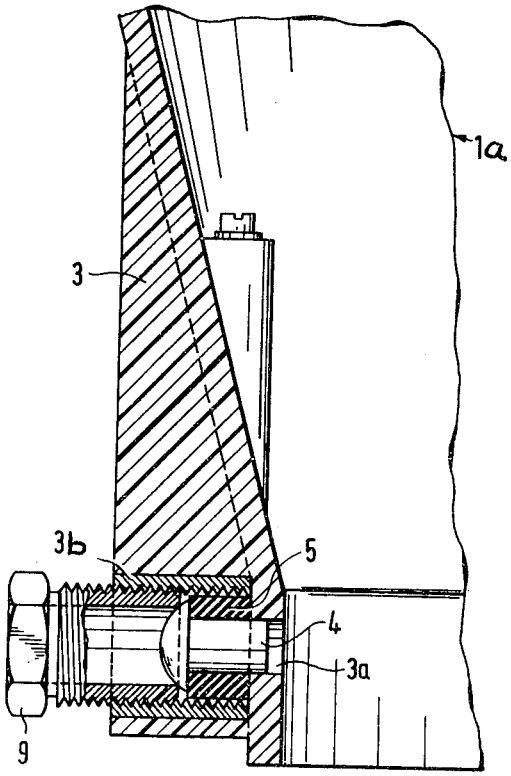
FIG. 3 is a sectional view of the electrical feedthrough of the lamp.

The lamp according to the invention has an enclosure 1 consisting of two major parts, a housing member 1*a* and attached thereto a releasable bezel 1*b* . The bezel locates and holds within the housing a floodlight or other electrical, e.g., incandescent light source 13 which is sealed by a sealing ring 11. The housing member 1*a* and the bezel 1*b* can be firmly joined together to form a single unit by means of bolts 12. The housing member 1*a* is enforced externally by ribs 2 which lend rigidity to the housing member 1*a* . The housing member 1*a* has extensions 3 which contain the electrical feedthroughs for the lamp, permitting the lamp to be used as a single source of illumination or in a multiple connection in which power passes from one lamp to the other. The lamp may have one, two or more extensions 3 and feedthroughs. The bezel 1*b* has frontal protrusions 6 in which is fashioned a groove 6*a* for receiving a snap ring that holds, for example, a color light filter disc. Each extension 3 has a radial opening 3*a* in which is molded or welded a threaded bushing 3*b*, preferably made of metal, for example, brass. Placed within the bushing 3*b* is a flexible and/or elastic disc, for example, a rubber or plastic disc 5, within which is inserted a pin or bolt 4, for example, made of plastic. Threaded within the bushing 3 is a hollow screw 9 which bears on the convex head of the bolt 4 or on a washer, not shown, placed on top of the bolt 4, thereby deforming the elastic disc 5 and causing it to seal the opening in all directions. In this manner, the feedthrough may be hermetically sealed and water is effectively prevented from entering the enclosure.

If the feedthrough is required for the passage of electrical cabling, the bolt 4 is removed, releasing the opening 3*a* to the passage of electrical wires and cables. In that case, the threaded engagement of the hollow screw 9 again causes a deformation of the elastic ring 5 causing it to seal the opening in all directions by pressing against the inside of the bushing 3*b* and the inserted cable 14.

The lower part of the bell-shaped housing member 1*a* has a mounting pedestal consisting of an arm 7 attached by reinforcing ribs 7*b* to a base plate 7*a* of preferably circular shape and provided with round or elongated holes 8 for mounting to a suitable surface. Preferably, the arm 7 is attached to one of the ribs 2 by a bolt and nut passing therethrough and permitting a change in the relative angular elevation of the lamp. If the mounting screws of the lamp are passed through the elongated holes 8, the lamp may be rotated to within the limit of the elongated holes.

Figure 4:
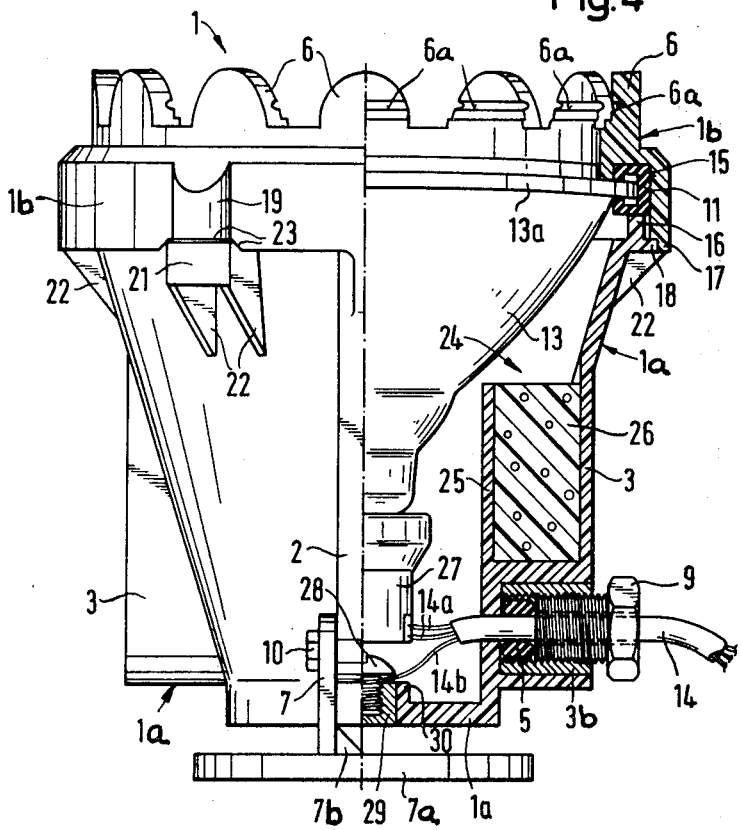
FIG. 4 is a vertical half section through the lamp according to the invention.

As best seen in FIG. 4, a lamp or incandescent light 13 is placed within the housing member 1*a* and its front edge 13*a* lies within a ring seal 11 having a C-shaped cross section. The sealing ring 11 lies within a recess 15 of the bezel 1*b* . The cooperation of the bezel, the recess 15, the sealing ring 11 and the edge 13*a* cause the correct positioning and holding of the lamp 13 within the housing 1*a* .

The bezel has a skirt 17 which overlaps a cooperating shoulder 18 on the housing member 1*a*, thereby contributing to the sealing properties of the light.

Figure 5:
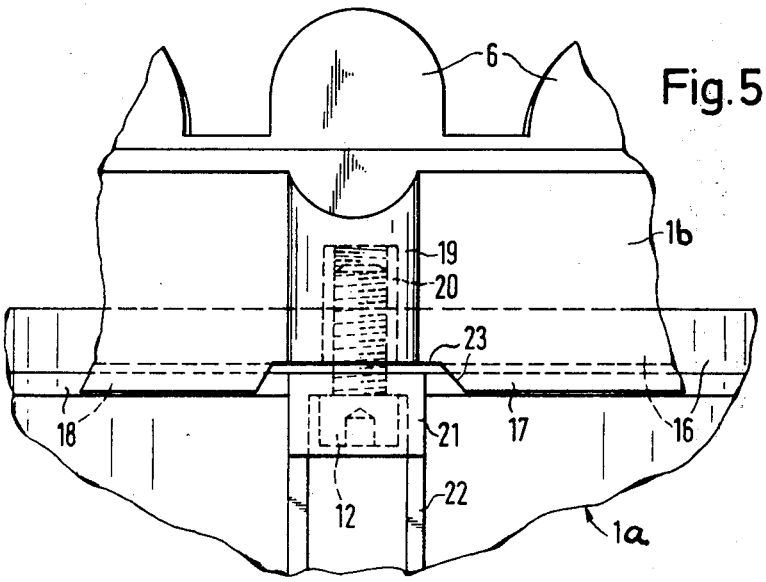
FIG. 5 is a partial front elevational view of a detailed construction of the lamp according to the invention.

The bezel 1*b* also has several protrusions 9, each of which contains a threaded sleeve 20 that is accessible from below and the threaded opening of which is parallel with the longitudinal extent of the lamp. Extending from the shoulder 18 of the housing member 1*b* are appropriate protrusions 21 opposite the bezel protrusions 19 so that threaded bolts may be passed through the protrusions 21 and the bezel 1*b* may be pulled against the housing 1*a* by tightening the bolts. The protrusions 21 are reinforced by reinforcing ribs 22. As best seen in FIG. 5, the region of the skirt 17 in the vicinity of the protrusions 21 is recessed, thereby preventing interference during assembly.

In order to increase the overall density of the lamp and cause it to be generally heavier than water, the inside of the housing is provided with walls 25 which define pockets 24 into which may be poured a plastic 26 containing lead granules. The pockets 24 lie generally directly above the threaded bushings 3*b* in the vicinity of the extensions 3. A lamp socket 27 may be screwed onto the lamp 13 and from it extend two electrical conductors 14*a* while a third ground connection 14*b* is connected to a grounding screw 28 which is threadedly engaged with a threaded sleeve 29, held preferably fixedly within a receiver boss 30 of the housing member 1*a*.

The waterproof lamp according the invention may be constructed in any suitable size and the details of construction may be adapted to prevailing conditions. Preferably the housing member 1*a*, the bezel 1*b* and the pedestal 7, 7*a*, 7*b* are integral members made from a synthetic material, preferably a thermoplastic synthetic material.

The foregoing is a description of a preferred exemplary but entirely non-limiting embodiment capable of numerous variants all within the scope and spirit of the invention.

What is claimed is:

1. A waterproof lamp, comprising:

a bell-shaped housing member having external reinforcing ribs, and at least one integral extension containing an electrical feedthrough connection and a weighting medium;

at least one electrical light source positioned in said housing;

sealing means positioned adjacent said light source;

a bezel, capable of releasably holding a color filter disc, and means thereon for clamping said bezel to said housing, said bezel being a bezel ring having a circumferential groove for holding said sealing means, said sealing means having a C-shaped cross section and said at least one electrical light source having a frontal edge which is held within said groove defined by said C-shaped cross section of said sealing means and wherein said housing member has a shoulder against which said bezel ring is clamped; thereby clamping said bezel ring to said housing member compresses said sealing means and holds in place said at least one electrical light source;

a pedestal attached to said housing member; and said housing memer, said bezel ring and said pedestal are individually integral units constructed of a synthetic material.

2. A lamp according to claim 1, wherein said bezel ring has a circumferential skirt which, when installed, overlaps said shoulder of said housing member.

3. A lamp according to claim 1, wherein circumference of said bezel ring is provided with a plurality of protrusions, respective threaded sleeves are inserted in said protrusions and wherein a region of said housing member near said bezel ring has protrusions with passages for mounting bolts to engage said threaded sleeves, and including mounting bolts extending through said passages and engaging said threaded sleeves to hold said bezel ring and said housing member together.

4. A lamp according to claim 3, wherein regions of said bezel ring adjacent to said plurality of protrusions of said housing member are recessed to prevent interference therewith during assembly.

5. A lamp according to claim 1, including a weighting medium, and wherein interior of said housing member in vicinity of said at least one integral extension has a wall surface defining a pocket in which said weighting medium is positioned.

6. A lamp according to claim 1, wherein said integral extension has an opening containing a threaded bushing.

7. A lamp according to claim 6, further comprising an elastic ring placed within said threaded bushing and still further comprising a plastic bolt located within said elastic ring, a hollow screw engaging said threaded bushing and said bolt causing deformation of said elastic ring, thereby sealing said electric feedthrough connection.

8. A lamp according to claim 1, further comprising a lamp socket, a hollow screw, a grounding screw, a grounding sleeve and an electrical cable containing a ground conductor, and an internal boss, said internal boss containing said grounding sleeve threadedly engaged by said grounding screw connected to said ground conductor of said electrical cable, said electrical cable passing through said electrical feedthrough connection, said electrical feedthrough connection consisting of an opening in said integral extension, said opening containing a threaded bushing and concentrically located therein an elastic sealing ring; wherein said electrical cable passes through said feedthrough connection, said hollow screw threadedly engages said bushing to thereby cause deformation of said sealing ring to seal said feedthrough connection, and wherein power conductors of said cable are connected to said lamp socket, said lamp socket threadedly engaging said electrical light source which comprises a light bulb.

9. A lamp according to claim 1, including a pedestal, said pedestal including a base plate, an arm vertically attached to said base plate, at least one further reinforcing rib reinforcing said arm, a bolt and nut, said arm being attached to one side of one of said external reinforcing ribs by said bolt and nut and permitting relative angular movement between said housing member and said pedestal.

10. A lamp according to claim 1, wherein, said housing member is made of a thermoplastic synthetic material.

* * * * *